US010413032B2

(12) United States Patent
Keenan

(10) Patent No.: US 10,413,032 B2
(45) Date of Patent: Sep. 17, 2019

(54) PONYTAIL HOLDER

(71) Applicant: Paul B. Keenan, Ottsville, PA (US)

(72) Inventor: Paul B. Keenan, Ottsville, PA (US)

( * ) Notice: Subject to any disclaimer, the term of this patent is extended or adjusted under 35 U.S.C. 154(b) by 33 days.

(21) Appl. No.: 14/998,820

(22) Filed: Feb. 22, 2016

(65) Prior Publication Data

US 2016/0270502 A1 Sep. 22, 2016

Related U.S. Application Data

(60) Provisional application No. 62/177,192, filed on Mar. 9, 2015.

(51) Int. Cl.

| | |
|---|---|
| ***A45D 8/12*** | (2006.01) |
| ***A45D 8/00*** | (2006.01) |
| ***A45D 8/34*** | (2006.01) |

(52) U.S. Cl.

CPC ..... *A45D 8/00* (2013.01); *A45D 8/34* (2013.01); *A45D 2008/004* (2013.01)

(58) Field of Classification Search

CPC ... A45D 8/00; A45D 8/34; A45D 8/36; A45D 2008/004; A45D 2008/006; A45D 2/14; A45D 2/146

See application file for complete search history.

(56) References Cited

U.S. PATENT DOCUMENTS

| | | | | | |
|---|---|---|---|---|---|
| 666,860 | A * | 1/1901 | Buzzacott | A45D 8/00 | 132/275 |
| D336,542 | S * | 6/1993 | Barradas | D28/37 | |
| 6,003,521 | A * | 12/1999 | Huang | A45D 8/00 | 132/273 |
| 6,401,726 | B1 * | 6/2002 | Sonstegard | A45D 2/40 | 132/246 |
| 2007/0175493 | A1 * | 8/2007 | Tandberg | A45D 8/36 | 132/275 |
| 2013/0284200 | A1 * | 10/2013 | Batista | A45D 8/36 | 132/275 |
| 2016/0242522 | A1 * | 8/2016 | Reile | A45D 8/34 | |

* cited by examiner

*Primary Examiner* — Rachel R Steitz
(74) *Attorney, Agent, or Firm* — Michael de Angeli

(57) ABSTRACT

A ponytail holder comprises a generally elongated, generally cylindrical member having first and second ends of a first diameter and a central section of lesser diameter, defining a relief for receiving an elastic band for securing a bundle of hair to said ponytail holder.

5 Claims, 1 Drawing Sheet

10
20
28

10
16b
16a
16b
16
14
12
18

12
16
18

10'
14
16
24
22a
22
26
26a 26
26a
22a
22

22
22a
14

PONYTAIL HOLDER

CROSS-REFERENCE TO RELATED APPLICATION

This application claims priority from provisional application Ser. No. 62/177,192, filed Mar. 9, 2015.

BACKGROUND OF THE INVENTION

It is well-known to arrange one's hair in a "ponytail" by gathering the strands of hair growing from the scalp into a bundle and securing it with a hairband, or simply by a rubber or elastic band. The hairband or rubber band is intended to remain in place on the bundle of hair by friction. This is commonly done to keep one's hair out of one's eyes during athletic contests and the like.

One problem with this common practice is that the hairband or rubber band tends to slide away from the scalp over time, requiring the operation to be repeated at intervals. If this merely has to be done too frequently, it is only inconvenient and annoying. However, if the wearer is an athlete and the ponytail comes loose at a critical time, it can interfere with the wearer's vision, for example, and could be a factor in the outcome of a contest or game. Accordingly, a reliable means of securing the bundle of hair in a ponytail is needed.

Hairbands are known with a tacky surface to partially adhere to the bundle of hair, as are hairbands the diameter of which are adjustable to increase the friction between the hairband and the bundle of hair, but neither are fully satisfactory.

OBJECTS AND SUMMARY OF THE INVENTION

It is therefore an object of the invention to provide a ponytail holder which will reliably stay in place, without being inconvenient to use.

The above object is met by the ponytail holder of the invention, which comprises in its simplest embodiment a "bobbin", meaning by this to refer to an elongated, generally radially-symmetric member, typically having rounded ends, and having a central section of reduced diameter, referred to as the "relief". This bobbin is placed into the center of the bundle of hair gathered to make a ponytail, and then a hairband or rubber band is drawn over the ponytail so as to confine the hair of the bundle in the relief. Alternatively, the hairband or rubber band can be placed over the bundle of hair first and the bobbin then forced into place.

The increased surface area of the relief bears against the hair in the bundle and significantly increases the friction as compared to the effect when the bobbin is absent, that is, where the friction is only between the hair and the hairband or rubber band. Accordingly, the ponytail is much more effectively secured.

Various options and improvements are within the scope of the invention. For example, the bobbin may be manufactured by injection molding of a thermoplastic material. The friction between the bobbin and the bundle of hair can be increased by placing a sleeve of a rubber material in the relief, as the coefficient of friction of rubber is considerably higher than that of most injection-moldable thermoplastics.

One end of the bobbin can be formed to define a "bulb" shape larger than the other end of the bobbin, so that the ponytail forms a pleasing shape as it exits the bobbin. This enlarged bulb can be made of rubber and may further be grooved, both to further increase the friction between the bundle of hair and the bobbin.

It is also possible to provide structure for attachment of additional adornments. For example, the bobbin may be formed to define a central aperture or a slot for insertion of a ribbon or the like, or to receive a length of string tied to a feather, a flower, a string of beads, or a hair extension.

BRIEF DESCRIPTION OF THE DRAWINGS

The invention will be better understood if reference is made to the accompanying drawings, in which.

DESCRIPTION OF THE PREFERRED EMBODIMENT

Figures 1, 2, 3, 4, 5, 6:
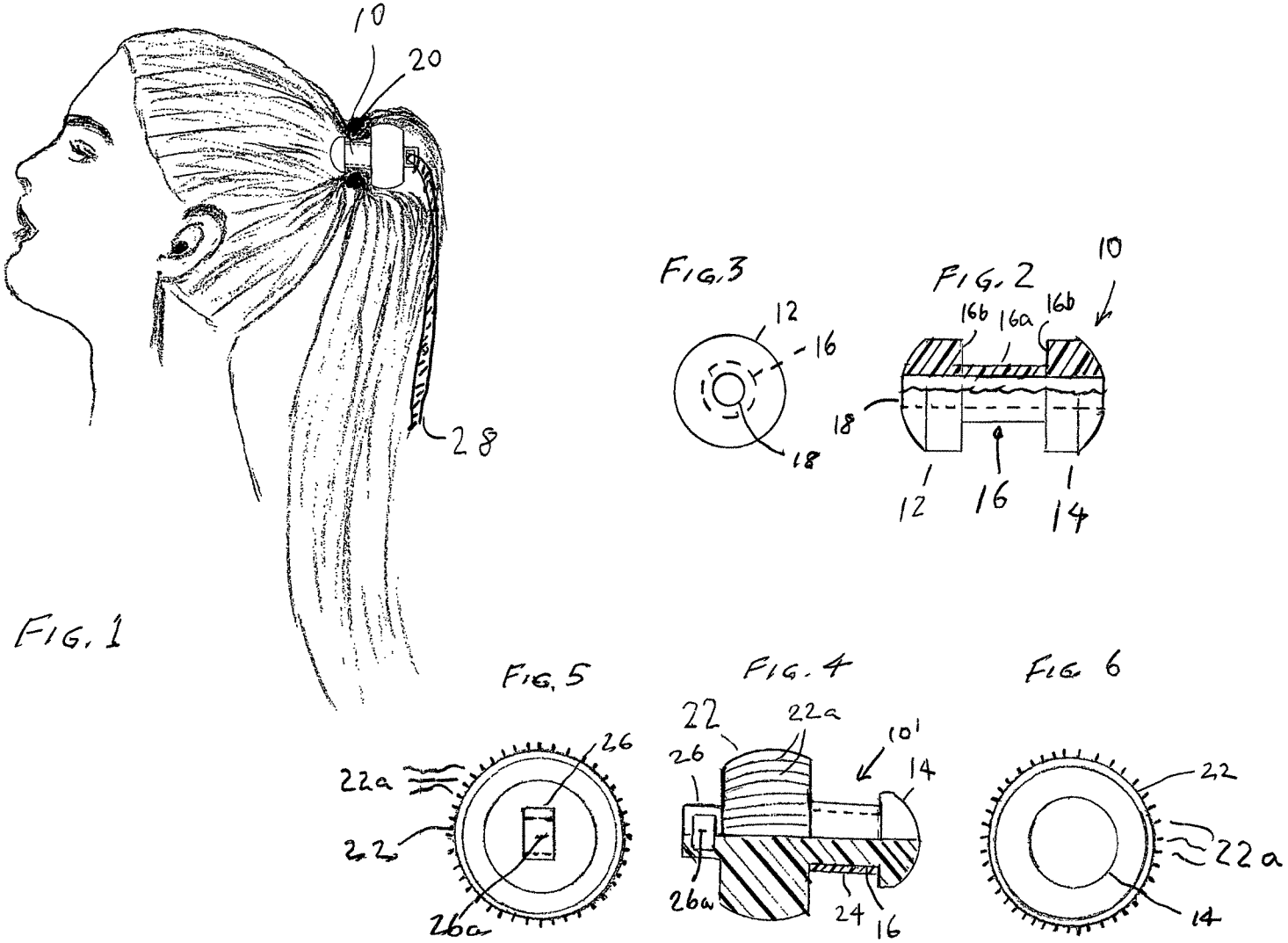
FIG. 1 shows a profile view of a woman with her hair in a ponytail, secured by the holder of the invention, and having an adornment in the form of a ribbon attached thereto.
FIG. 2 shows an elevation and partial cross-section of a first embodiment of the invention.
FIG. 3 is an end view of the embodiment of FIG. 2.
FIG. 4 is an elevation and partial cross-section of a second embodiment of the invention, showing certain further options and improvements.
FIG. 5 is a view from the left end of the embodiment of FIG. 4.
FIG. 6 is a view from the right end of the embodiment of FIG. 4.

As shown by FIGS. 2 and 3, in its simplest embodiment the ponytail holder 10 of the invention comprises a unitary "bobbin" which in production will typically be molded of a thermoplastic. As shown by FIG. 3, the ponytail holder is a generally cylindrical elongated member that in this embodiment is radially symmetric. Ponytail holder 10 defines first and second end caps 12 and 14 respectively, which are spaced from one another by a central section 16 of smaller diameter, referred to as the relief 16. Relief 16 thus defines a bottom 16*a* and end walls 16*b*. The end surfaces of first and second end caps 12 and 14 may be broadly radiused, as illustrated. A central bore 18 may extend through ponytail holder 10, to receive a string carrying an adornment such as a ribbon, feather, hair extension, or the like.

Typical dimensions for the ponytail holder in this embodiment are as follows: The end caps 12 and 14 are ¾" in diameter and 0.200" thick while relief 16 is ⅜" in diameter and ⅝" long for an overall length of about 1.025".

FIG. 1 shows the ponytail holder of the invention in use, although in this drawing the embodiment of FIGS. 4-6, discussed below, is illustrated. In practice of the invention, the wearer's hair is drawn by hand into a bundle, and the ponytail holder 10 inserted into the bundle, near the scalp. An elastic band 20 is then stretched over the bundle and maneuvered into position so that it fits into the relief 16, and so that the hair of the bundle is drawn into frictional relation with the bottom 16*a* and end walls 16*b* of the relief 16. Noting that the force exerted by the hairband can only be a few pounds, to allow the user to readily stretch the band and maneuver it into place, it will be appreciated that the additional surface area provided by the relief will provide substantial additional frictional force holding the ponytail in place. That is, employment of the ponytail holder of the invention provides substantial additional frictional engagement between the hair of the bundle and the ponytail holder as compared to the typical practice of simply using a rubber band or elastic hair band to confine the wearer's hair into the bundle. Therefore, the ponytail holder 10 of the invention stays in place and the ponytail is unlikely to become loose during activity.

FIGS. 4-6 show further enhancements that may be provided. In order to provide an attractive shape to the ponytail, the distal end of the bobbin 10' may comprise a substantially enlarged, generally part-spherical bulb, as indicated at 22. The bobbin in this embodiment can be molded of a thermoplastic; alternatively, bulb 22 can be molded of rubber, and have a bore formed therein sized to as to be a light press fit over a separate bobbin. Bulb 22 may have grooves formed on its surface, as shown at 22*a*; especially where the hair of the bundle exits the relief, grooves 22*a* would provide additional friction, further tending to hold the ponytail holder 10 in place. Bulb 22 may be 1.5" in diameter and ⅞" long. The overall length of the ponytail holder in this embodiment is thus about 1.625".

Similarly, to provide additional friction, a rubber sleeve 24 may be disposed over the relief 16. A similar rubber sleeve may be employed in the embodiment of FIGS. 2 and 3.

Further, in lieu of bore 18 shown in the FIGS. 2 and 3 embodiment, a tongue 26 defining an aperture 26*a* may be formed on the distal end of the bobbin 10, for convenient attachment of a ribbon 28 or like adornment, as shown in FIG. 1. Such a tongue with aperture could be provided in the embodiment of FIGS. 2 and 3.

The invention also includes the method of use of the ponytail holder, as described above.

Further improvements and modifications will occur to those of skill in the art. Therefore, the invention should not be limited to the embodiments specifically described above, but only by the following claims.

What is claimed is:

1. A method for securing the hair of a wearer securely in a ponytail, comprising the steps of:

providing a ponytail holder, said ponytail holder comprising an elongated, substantially inflexible cylindrical central section and first and second end caps, said first end cap being of at least a first diameter and said second end cap being of at least equal diameter as said first end cap, said second end cap forming a partially spherical bulb, and said cylindrical central section being of lesser diameter than said first end cap and spacing said first end cap from said second end cap, whereby said central section of lesser diameter defines a relief for receiving an elastic band for securing a bundle of hair to said ponytail holder, and further comprising a sleeve of rubber material disposed over said relief;

forming the hair of the wearer into a bundle;

disposing said ponytail holder within said bundle at a desired position; and maneuvering an elastic band over the bundle and the ponytail holder such that said elastic band draws the bundle into the relief.

2. The method of claim 1, wherein the external surface of said bulb is grooved.

3. The method of claim 1 wherein said ponytail holder further comprises a tongue having an aperture therein for having an adornment secured thereto.

4. The method of claim 1, wherein the ponytail holder has a central bore for having an adornment secured hereto.

5. The method of claim 1, wherein said generally elongated, generally cylindrical member is molded of a thermoplastic.

* * * * *